US008100665B2

(12) United States Patent
De Filippis et al.

(10) Patent No.: US 8,100,665 B2
(45) Date of Patent: Jan. 24, 2012

(54) FAN MODULE

(75) Inventors: Pietro De Filippis, Milan (IT); Brian Havel, London (CA); Harald Redelberger, Kürnach (DE)

(73) Assignee: Brose Fahrzeugteile GmbH & Co. KG Wurzburg, Wurzburg (DE)

( * ) Notice: Subject to any disclaimer, the term of this patent is extended or adjusted under 35 U.S.C. 154(b) by 721 days.

(21) Appl. No.: 12/066,573

(22) PCT Filed: Sep. 13, 2006

(86) PCT No.: PCT/EP2006/066309

§ 371 (c)(1),
(2), (4) Date: Aug. 14, 2008

(87) PCT Pub. No.: WO2007/036431

PCT Pub. Date: Apr. 5, 2007

(65) Prior Publication Data

US 2009/0151911 A1 Jun. 18, 2009

(30) Foreign Application Priority Data

Sep. 27, 2005 (DE) ..... 10 2005 046 180

(51) Int. Cl.
*F04D 29/38* (2006.01)

(52) U.S. Cl. ..... 416/238

(58) Field of Classification Search ..... 416/196, 416/238, 242
See application file for complete search history.

(56) References Cited

U.S. PATENT DOCUMENTS

| | | | | |
|---|---|---|---|---|
| 2,872,988 | A * | 2/1959 | Koch et al. | 416/196 R |
| 5,498,130 | A | 3/1996 | Wakley et al. | 415/213.1 |
| 6,024,536 | A | 2/2000 | Tsubakida et al. | 416/189 |
| 6,672,839 | B2 * | 1/2004 | Schloetzer | 416/238 |
| 2005/0186070 | A1 | 8/2005 | Zeng et al. | 415/211.2 |
| 2005/0196276 | A1 | 9/2005 | Sun | 415/211.2 |
| 2006/0086078 | A1 * | 4/2006 | Paul | 60/226.1 |

FOREIGN PATENT DOCUMENTS

| | | |
|---|---|---|
| CN | 1 540 170 (A) | 10/2004 |
| DE | 197 51 042 A1 | 5/1998 |
| EP | 0 387 987 A2 | 1/1990 |
| GB | 2 290 832 A | 1/1996 |

* cited by examiner

*Primary Examiner* — Calvin Lee
(74) *Attorney, Agent, or Firm* — Westman, Champlin & Kelly, P.A.

(57) ABSTRACT

A fan module, particularly for cooling motor vehicle engines allows for improved cooling of the fan motor. The fan housing (101) in which the fan motor (105) is arranged has fixed air-channeling elements (109) which are arranged in the region of a fan hub (2) of the fan wheel (1) driven by the fan motor (105) and which only partially cover an outlet cross section (102, 118) defined by the fan housing (101).

18 Claims, 7 Drawing Sheets

FAN MODULE

CROSS-REFERENCE TO RELATED APPLICATIONS

This application is a U.S. national stage application of International Application No. PCT/EP2006/066309 filed Sep. 13, 2006, which designates the United States of America, and claims priority to German application number 10 2005 046 180.8 filed Sep. 27, 2005, the contents of which are hereby incorporated by reference in their entirety.

TECHNICAL FIELD

The invention relates to a fan module, in particular for cooling motor vehicle engines.

BACKGROUND

Axial fans which are disposed between a radiator and a combustion engine of a motor vehicle are known from the prior art. Axial fans of said kind are assigned air guide vanes which cover the entire area of the outlet cross-section and serve to redirect the rotational energy of the streaming air in an axial direction in order thereby to intensify the axial air flow.

Axial-radial fans are becoming increasingly important owing to the fact that less and less space is available to allow a clearance between the combustion engine and the fan module due to changed installation conditions in the engine compartments of modern motor vehicles. FIGS. 14 and 15 show schematics of a fan module 400 disposed between a radiator 200 and combustion engine 300 of a motor vehicle and having a fan motor 500, FIG. 11 showing an axial air flow 600 and FIG. 12 an axial-radial air flow 700. With designs of said type, the air stream enters the fan axially and exits the latter again partially radially. In this arrangement, however, the use of known air guide vanes leads to a reduction in the performance of the fans, since radial air flows are disrupted due to the deflecting of the air in the axial direction by the air guide vanes.

Furthermore the operating temperature of the fan motor is increased due to the constricted layout, which necessitates more effective cooling of the fan motor as well as in particular the integrated electronics. At the same time more and more powerful fan motors are being used, so the cooling requirement of the fan motor is also steadily increasing. Finally, higher ambient and operating temperatures for the fan motors must also increasingly be assumed due to the more and more powerful combustion engines.

EP 0387987 A2 describes a support ring for receiving a cooling fan motor in a housing, wherein an inner support ring is positioned centrally in a circular opening with the aid of radial support vanes. The radial support vanes are assigned additional stabilizing rings which serve on the one hand to increase the mechanical stability of the mounting apparatus and on the other hand to redirect the cooling airflow from a radial to an axial direction and thus increase the fan's efficiency.

US 2005/0186070 A1 shows a fan assembly in which the air inlet opening is covered by air guide elements, the number of air guide elements in a first area in the center of the opening being different from the number of air guide elements in a second area at the circumference of the opening. In this arrangement the number of air guide elements is chosen in accordance with possibly occurring pressure differences across the length of the fan blades in such a way that the fan performance is optimized.

SUMMARY

A fan module which enables improved cooling of the fan motor may be provided by an embodiment of a fan module comprising a fan housing, a fan motor disposed in the fan housing, and a fan wheel driven by the fan motor, wherein the fan housing has fixed air guiding elements which are arranged in the area of a fan hub of the fan wheel and only partially cover an outlet cross-section defined by the fan housing, wherein fan blades are arranged at the fan hub, with a number of fan blades in the area of the fan hub having a fan blade section for the purpose of forming a flow opening, which fan blade section is embodied in the manner of a fixed split flap for the purpose of generating an increased static air pressure close to the fan hub.

According to a further embodiment, the air guiding elements may cover an area of 10 to 50 percent of the outlet cross-section. According to a further embodiment, air guiding elements may be arranged at an angle of attack $\alpha$ relative to the flow direction of the cooling air and that the angular position of the air guiding elements is dependent on the radius of the fan wheel. According to a further embodiment, the angle of attack $\alpha$ of the air guiding elements may be between $\alpha=12°$ for $r=d$ and $\alpha=45°$ for $r=1.3\times d$, where "r" denotes the radius of the fan wheel and "d" the diameter of the fan hub. According to a further embodiment, the outer ends of the air guiding elements may be connected to one another by way of an outer race. According to a further embodiment, the radial length of the flow opening may correspond to a maximum of 30 percent of the hub radius. According to a further embodiment, the width of the flow opening may be between 35 and 45 percent of the fan blade width. According to a further embodiment, the angle of attack of the fan blade section may be 40 to 55 degrees greater than the angle of attack of the fan blade. According to a further embodiment, According to a further embodiment, the fan blade section may be arranged in the area of the trailing edge of the fan blade. According to a further embodiment, the radial length of the flow opening may be dimensioned in such a way that the flow opening terminates with the outer race of the air guiding elements.

BRIEF DESCRIPTION OF THE DRAWINGS

The invention is explained in more detail below with reference to an exemplary embodiment which is described with the aid of figures, in which.

DETAILED DESCRIPTION

Figure 1:
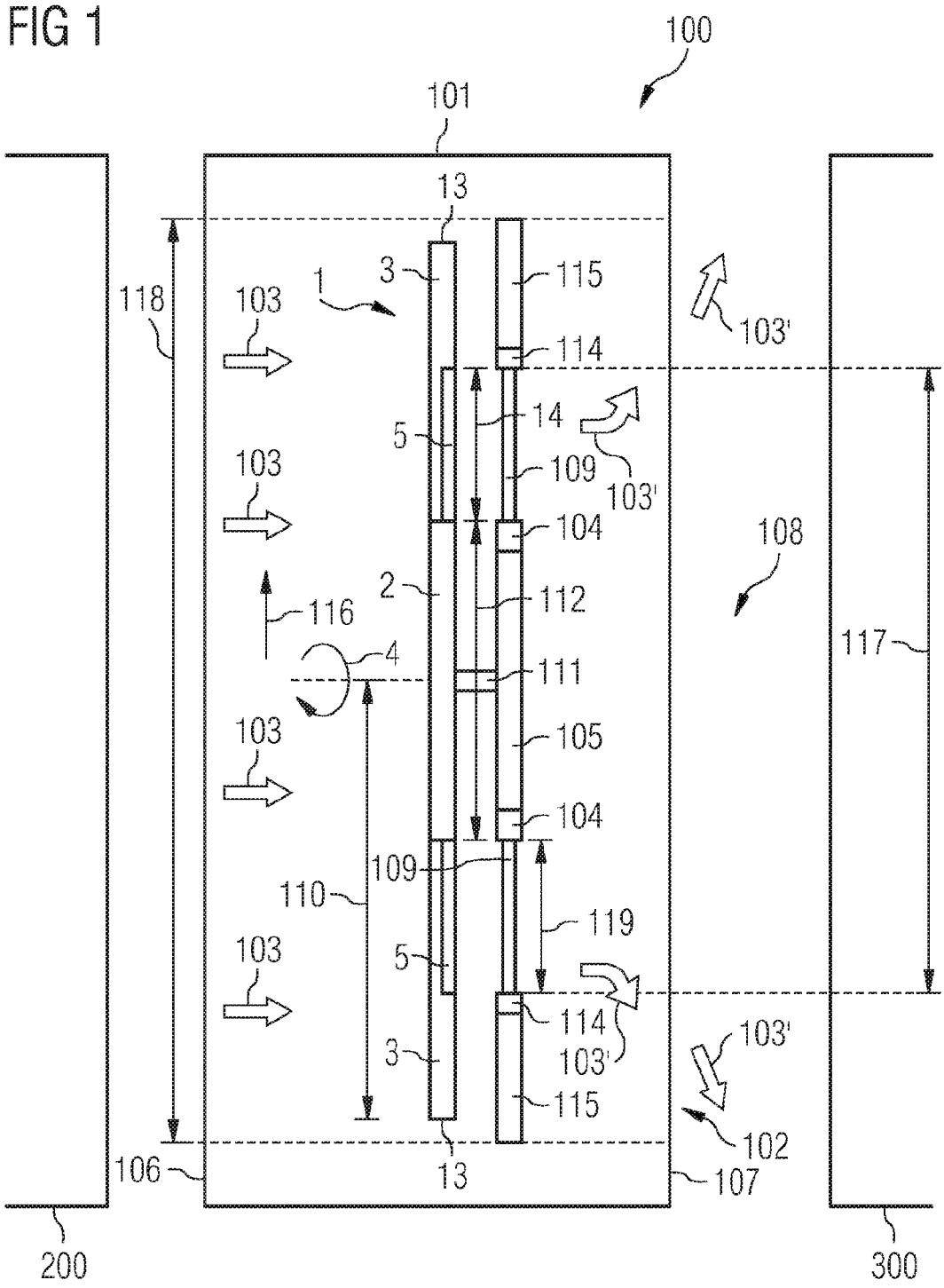
FIG. 1 shows a schematic view of a fan module.

According to an embodiment, a fan module is provided, in particular for cooling motor vehicle engines, having a fan housing, having a fan motor (in particular an electric motor) disposed in the fan housing, and having a fan wheel driven by the fan motor, the fan housing having fixed air guiding elements which are disposed in the area of a fan hub of the fan wheel and only partially cover an outlet cross-section defined by the fan housing. Arranged at the fan hub are fan blades, with a number of fan blades having, in the area of the fan hub, a fan blade section for forming a flow opening, which fan blade section is embodied in the manner of a fixed split flap for the purpose of generating an increased static air pressure close to the fan hub.

According to an embodiment, therefore, the cooling of the fan module is improved by implementing structural modifications to the fan housing, which is to say the shroud supporting the fan motor. Provided on the fan housing for this purpose are air guiding elements, in particular in the form of air guide vanes. By means of said air guiding elements an additional pressure difference is created between the front side and rear side of the fan module.

In other words the rotational energy that would otherwise be unused, or to express it another way, the tangential portion of the air flow through the fan, is converted into static pressure. The increased pressure difference between the motor front side and the motor rear side results in the air flow through the fan motor, which is implemented in an open style of design, being increased and consequently the cooling efficiency of the fan motor being substantially improved. Nonetheless, the air guiding elements do not lead to a deterioration in the radial air stream, because they do not extend over the entire area of the outlet cross-section. Moreover the air guiding elements are arranged centrally in the outlet cross-section, more specifically in the area of the fan hub, with the result that the major part of the air flow occurring at the outer circumference of the fan wheel remains undisturbed by the air guiding elements. The main air capacity for cooling the combustion engine is converted in the outer area of the fan (in the area of the blade tip).

For a further improvement in the cooling efficiency of the fan motor it is provided that a number of fan blades in the area of the fan hub have a fan blade section for forming a flow opening which is embodied in the manner of a fixed split flap for the purpose of generating an increased static air pressure close to the fan hub. This causes the pressure difference between the front side and rear side of the fan module to be increased. As a result a greater volume of air is directed past the gap between fan hub and fan motor, leading to an intensification of the Venturi effect in the gap and hence to an increased cooling air stream through the fan motor.

The cooling efficiency of the fan module is therefore improved according to an embodiment towing to structural modifications made to the fan blades. For this purpose there is provided on each fan blade close to the fan hub a fan blade section that is permanently extended out of the profile of the fan blade, resulting in a kind of "split blade" or "slotted blade" having a primary or main vane and a secondary or auxiliary vane. In this arrangement the auxiliary vane is formed by the permanently extended fan blade section and the main vane by the (non-extended) remainder of the fan blade. The terms "split blade" and "split fan blade" are used synonymously in the following description.

This embodiment is based on the use of split fan blades of this type in axial fans. The operating principle of an extended fan blade section of this type serving as an auxiliary vane essentially corresponds to that of a split flap, as used for example in the aviation industry as a lifting aid at the trailing edge of wings. As a result of the fact that a part of the fan blade (namely the auxiliary vane) is extended, the fan blade curvature is increased. Flow openings are created on the fan blades as a result of the extending of the fan blade sections according to an embodiment. The angle of attack of the fan blade sections acting as auxiliary vanes and hence the angle of attack for the air flowing through the fan module is different from the angle of attack of the main vanes.

It is particularly advantageous that the flow is directed by means of the auxiliary vanes in such a way that an undesirable flow separation can be prevented by the fan blades. What is achieved thereby is that on the one hand the maximum fan efficiency for the main air stream is improved because the recirculation effects are reduced. The tangential air velocity (circumferential speed) is considerably increased compared with conventional fan modules, as a result of which the axial proportion is also increased at the same time, leading to an intensified cooling air stream. On the other hand, the increased cooling air stream through the fan motor results in improved cooling of the fan motor, including the integrated electronics.

What is achieved by concentrating the flow openings in the area of the fan hub is that the radial ventilation effect on the rear of the fan module desired in the case of an axial-radial flow profile is not impaired in the outer areas of the fan.

An improvement in the cooling of fan motors may thus be achieved. This means, for example, that more powerful fan motors can be employed or that existing fan motors can be used at higher ambient temperatures.

According to an embodiment the air guiding elements cover an area of 10 to 50 percent of the outlet cross-section. The covered area is dependent to about 20% on the chosen fan diameter, to about 70% on the hub diameter and to about 10% on the clearance between the axial fan module and the combustion engine.

In a further embodiment the angular position of the air guiding elements is dependent on the fan radius r. The angle of attack $\alpha$ changes in this case as a function of the fan radius r in a range from preferably $\alpha=12°$ for $r=d$ to $\alpha=45°$ for $r=1.3\times d$, where d denotes the diameter of the fan hub.

The angle of attack of the air guiding elements preferably may change in the radial direction, and moreover in such a way that optimum recovery of the tangential air energy is possible for the respective air vector and its direction. In other words, what is intended to be achieved by a corresponding embodiment of the air guiding elements is that a maximally high proportion of the tangential energy will be redirected in the axial direction.

According to a further embodiment the outer ends of the air guiding elements are connected to one another by way of an outer race. A particularly stable construction is achieved thereby. The outer race may be preferably shaped in such a way that the air flow passing through in an axial-radial manner is not obstructed. In this case the race is embodied in such a way that the axially inflowing air is led away radially, without a conscious redirection (by means of a deflecting element, for example) being effected.

According to a further embodiment the flow openings run, starting directly from the fan hub, radially outward in the direction of the ends of the fan blades. The radial length ("height") of the flow openings may correspond in this case preferably to a maximum of 30 percent of the hub radius. However, flow openings having a greater radial length are also possible, up to and including flow openings which run over the entire radial length of the fan blade.

According to a further embodiment the width of the flow openings may be preferably between 10 and 50 percent of the fan blade width, referred to the respective radial position. A particularly good cooling effect could be achieved if the width of the flow openings is equivalent to between 35 and 45 percent of the fan blade width.

According to a further embodiment the angle of attack of the auxiliary vane formed by the extended fan blade section is 25 to 70 degrees greater than the angle of attack of the main vane. A particularly good cooling effect could be achieved if the angle of attack of the auxiliary vane is 40 to 55 degrees greater than the angle of attack of the main vane.

In this arrangement the auxiliary vane formed by the extended fan blade section can be extended in various ways. In other words the flow opening is arranged either toward the pressure side or toward the suction side. Which variant may be preferred is dependent first and foremost on the axial installation space available.

The extended fan blade sections and hence the flow openings may be preferably arranged in the area of the trailing edge of the fan blades. This results in a particularly great flow intensification effect.

If the fan blade sections are profiled, in particular curved like airfoils, the desired flow effect can be improved further.

It is particularly advantageous in addition if the radial length of the flow openings is dimensioned in such a way that the flow openings terminate with the outer race of the air guiding elements. This then results in a particularly effective higher tangential velocity. This can be used by the air guiding elements correspondingly arranged on the fan housing so that an optimal interaction between air guiding elements and flow openings is produced.

Figure 2:
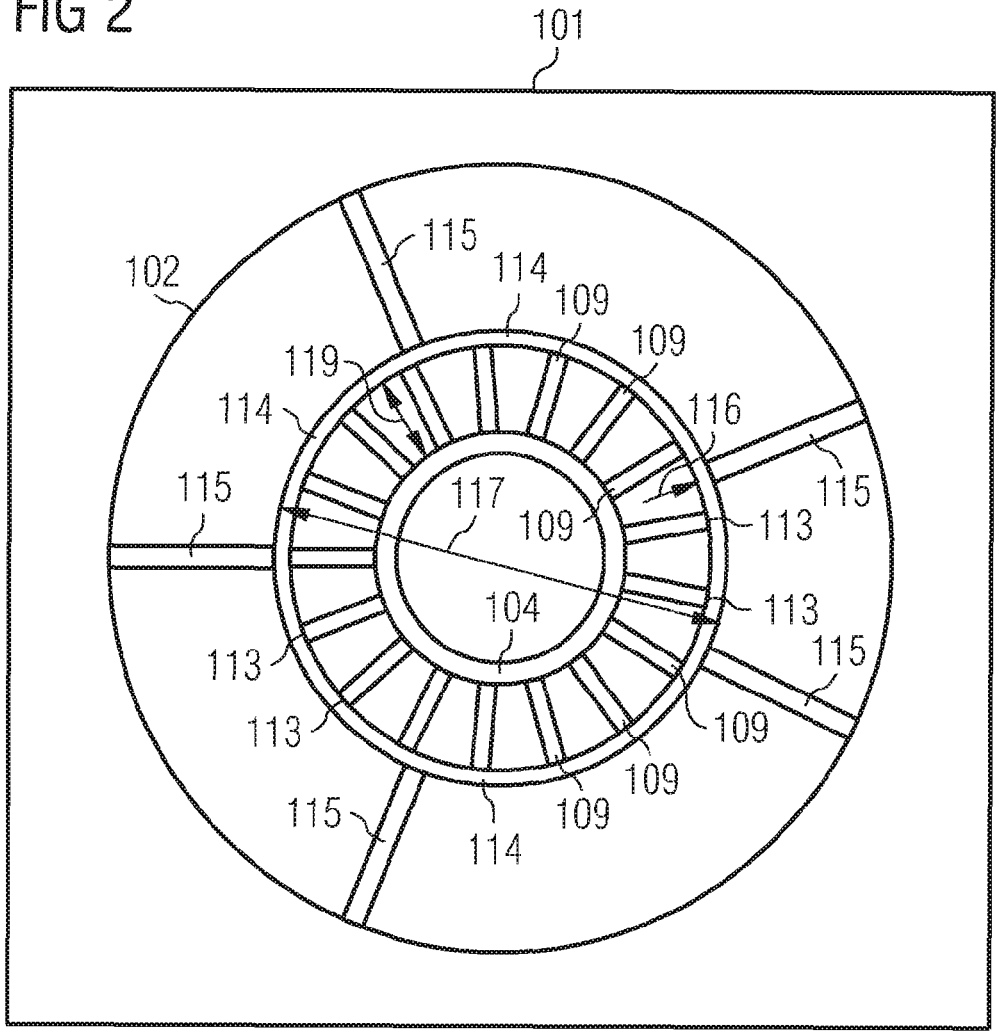
FIG. 2 shows a schematic side view of the shroud according to an embodiment.

FIGS. 1 and 2 show an axial fan module 100, as disposed between a radiator 200 and a combustion engine 300 in the engine compartment of a motor vehicle. The fan module 100 has a shroud 101 having a circular opening 102 (air passage opening). Said opening 102 serves as an air outlet opening for the cooling air flowing through the fan module 100. Arranged in the center of the opening 102 is a motor mounting ring 104 which serves to support an electric motor, the fan motor 105. The fan motor 105 drives a fan wheel 1 via a drive shaft 111. The fan wheel 1 has a fan hub 2 and fan blades 3. An air stream is generated in the direction of the combustion engine 300 with the aid of the fan wheel 1. Said air stream is an axial-radial flow. The flow direction of the cooling air is indicated by means of arrows 103 for the axially inflowing air and arrows 103' for the radially outflowing air. This means that the air enters the fan module 100 axially on the inflow side 106 (front side), but exits the fan module 100 axially-radially on the outlet side 107 (rear side) and enters the intermediate space 108 between fan module 100 and combustion engine 300.

Figure 3:
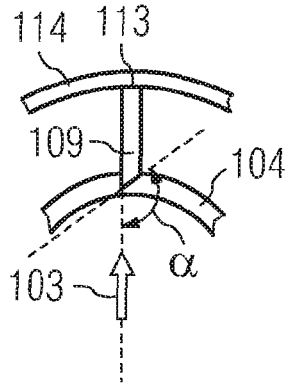
FIG. 3 shows a detail view of an air guiding element.

Branching out from the motor mounting ring 104, a number of air guiding elements 109 extend outward in a radial direction 116 in the form of air vanes. In the embodiment illustrated, the radius 110 of the fan wheel 1 is equivalent to 1.3 times the diameter 112 of the fan hub 2. The angle of attack $\alpha$ of the air guiding elements 109 of the shroud 101 in the flow direction 103 is $\alpha$=45°; cf. FIG. 3. The outer ends 113 of the air guiding elements 109 are connected to one another by way of an outer race 114 which is shaped in such a way that it does not obstruct the through-flowing axial-radial air flow 103. The outer race 114 is connected to the shroud 101 by way of radial support vanes 115 running in the radial direction 116 in the manner of retaining arms. In other words the fan motor 105 is held by this means in the shroud 101. The diameter 117 of the outer race 114 is significantly less than the diameter 118 of the opening 102 of the shroud 101, though greater than the diameter 112 of the fan hub 2.

In order to generate a cooling air stream through the open fan motor 105, a pressure difference is necessary between the inflow side 106 and the outlet side 107 of the fan module 100. As a result of the arrangement of the air guiding elements 109 the pressure on the outlet side 107 of the fan module 100 and hence the pressure difference between inflow side 116 and outlet side 107 is increased. At the same time the radial flow of the cooling air in the outer areas of the fan wheel 1 is not affected.

Figure 4:
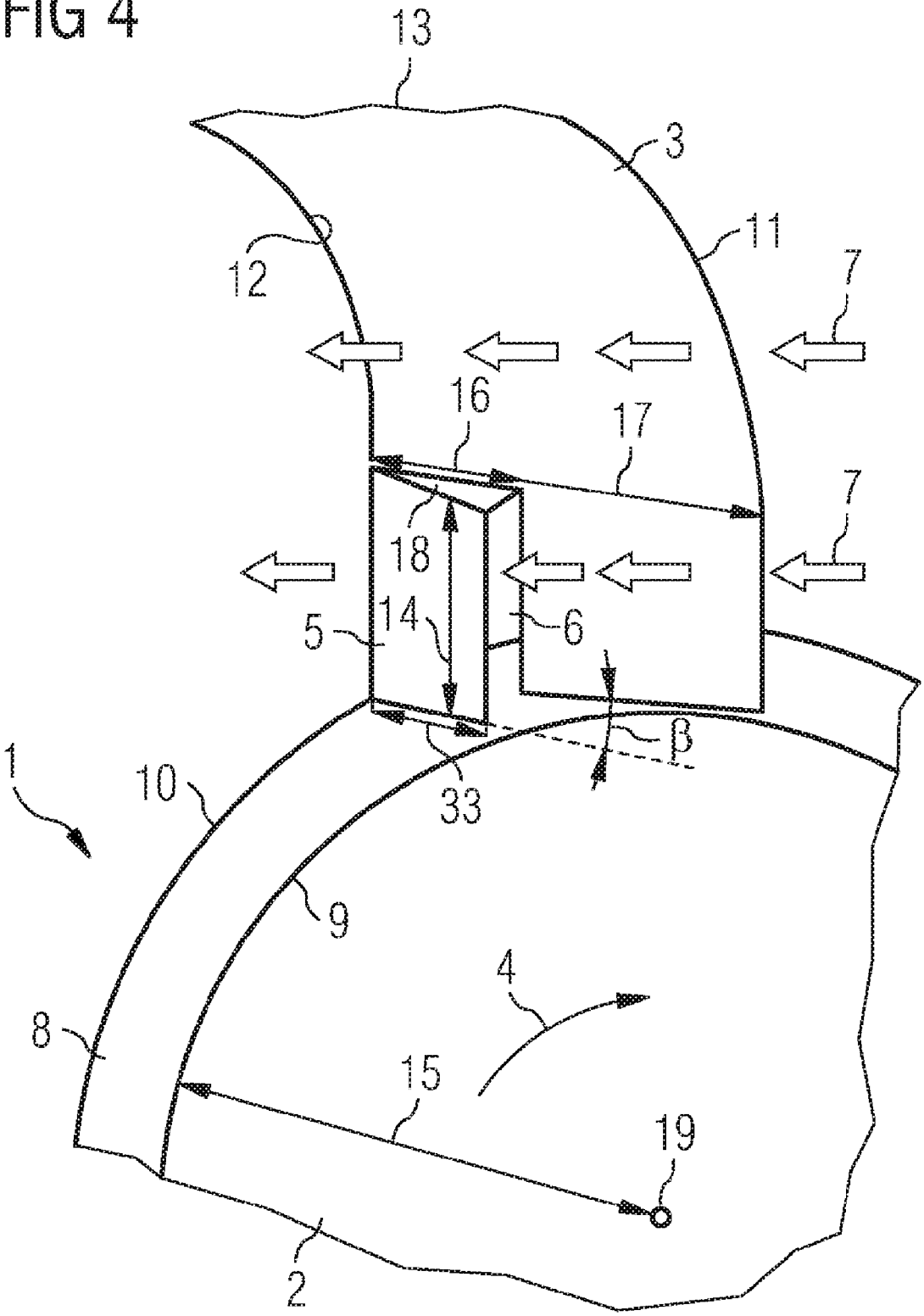
FIG. 4 shows a perspective view of a fan blade with flow opening.
Figure 5:
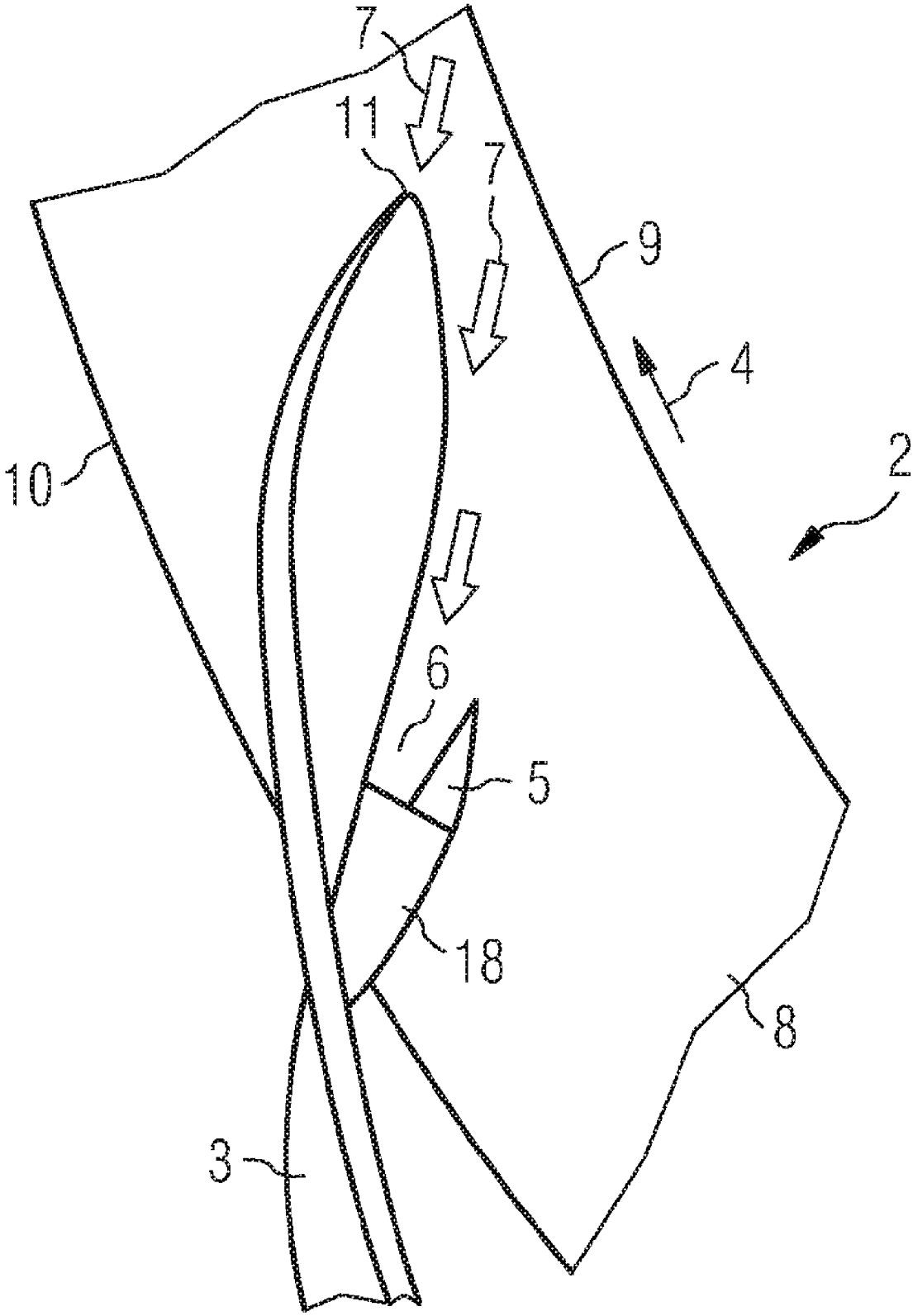
FIG. 5 shows a plan view onto the hub circumference of the fan blade from FIG. 4.
Figure 6:
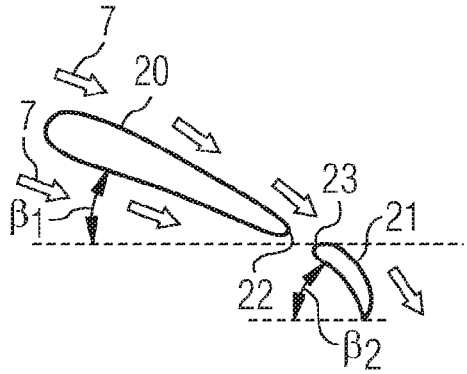
FIG. 6 shows a schematic representation of a first embodiment.
Figure 7:
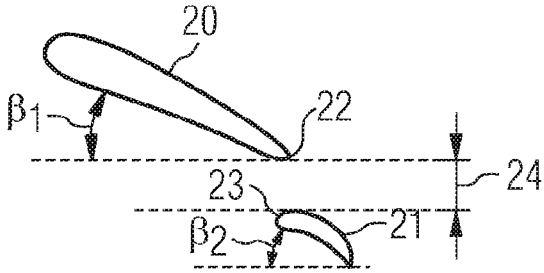
FIG. 7 shows a schematic representation of a second embodiment.
Figure 8:
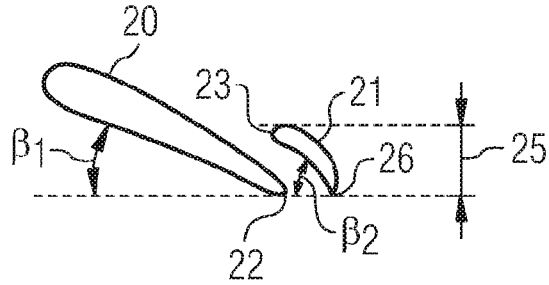
FIG. 8 shows a schematic representation of a third embodiment.
Figure 9:
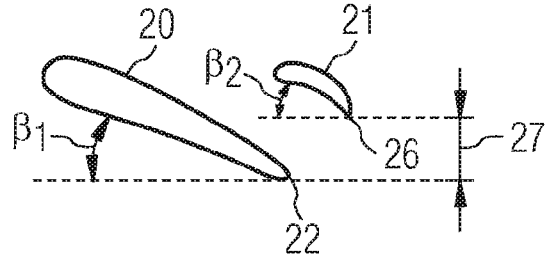
FIG. 9 shows a schematic representation of a fourth embodiment.

FIGS. 4 and 5 show a part of the fan wheel 1. When the fan wheel 1 is rotating, the fan hub 2 rotates in the direction of rotation 4. In the area of the fan hub 2 the illustrated fan blade 3 has a fan blade section 5 for forming a flow opening 6. The fan blade section 5 is embodied in the manner of a fixed split flap and serves to generate an increased static air pressure close to the fan hub 2. To better illustrate the flow ratio, the air flow direction relative to the rotating fan blades is indicated in the figures by means of arrows 7.

The fan blade 3 runs on the hub circumference 8 at an angle of attack from the leading edge 9 of the fan hub 2 to the trailing edge 10 of the fan hub 2. In other words the leading edge 11 of the fan blade 3 in FIG. 4 points to the right toward the viewer, while the trailing edge 12 of the fan blade 3 points to the left away from the viewer. The extended fan blade section 5 and hence the flow opening 6 is arranged in the area of the trailing edge 12 of the fan blade 3.

The flow opening 6 formed by the extended fan blade section 5 is delimited at the bottom by the hub circumference 8. In other words the flow opening 6 extends directly from the fan hub 2 radially outward in the direction of the fan blade end 13. The radial length ("height") 14 of the flow opening 6 is equivalent in this case to 30 percent of the hub radius 15, the hub radius corresponding to the distance from the hub axle 19 to the hub circumference 8. The radial length 14 of the flow openings 6 is dimensioned in such a way that the flow openings 6 terminate with the outer race 114 of the air guiding elements 109. In other words the length 119 of the air guiding elements 109 corresponds to the radial length 14 of the flow opening 6. The width 16 of the flow opening amounts to 35 percent of the fan blade width 17. In the exemplary embodiment shown the width 33 of the fan blade section 5 corresponds to the width 16 of the flow opening 6. The angle of attack $\beta$ of the fan blade section 5 (auxiliary vane) is 25 degrees greater than the angle of attack of the fan blade 3 (main vane). The flow opening 6 is delimited to the outside in the direction of the fan blade end 13 by a covering surface 18 which connects the fan blade section 5 to the fan blade 3. Instead of the covering surface 18, however, an aerodynamically optimized flowing transition from the auxiliary vane 5 to the fan blade 3 can be provided.

In further exemplary embodiments (not shown), however, the width 33 of the fan blade section 5 can also be less than or greater than the width 16 of the flow opening 6.

For reasons of clarity only a single fan blade 3 is shown in each case in the figures. Preferably, however, all fan blades 3 of the fan wheel 2 may have the fan blade sections 5 according to an embodiment. As shown schematically in FIGS. 6 to 9, the secondary or auxiliary vane 21 formed by means of the extended fan blade section 5 can be extended in various ways. In this case the angle of attack $\beta_2$ of the fan blade sections 5 acting as auxiliary vanes 21 and hence the angle of attack for the air flowing through the fan module is always greater than the angle of attack $\beta_1$ of the primary or main vanes 20.

In a first, simple embodiment (FIG. 6) the trailing edge 22 of the main vane 20 lies in the same plane as the leading edge 23 of the auxiliary vane 21.

In a second embodiment (FIG. 7) the leading edge 23 of the auxiliary vane 21 is arranged offset negatively, i.e. in the direction of the trailing edge 10 of the fan hub 2, relative to the trailing edge 22 of the main vane 20 by the distance 24 in the axial direction.

In a third embodiment (FIG. 8) the trailing edge 26 of the auxiliary vane 21 lies on the same plane as the trailing edge 22 of the main vane 20. Expressed in another way, the leading edge 23 of the auxiliary vane 21 is arranged offset positively, i.e. in the direction of the leading edge 9 of the fan hub 2, relative to the trailing edge 22 of the main vane 20 by the distance 25 in the axial direction.

In a fourth embodiment (FIG. 9) the trailing edge 26 of the auxiliary vane 21 is arranged offset positively, i.e. in the direction of the leading edge 9 of the fan hub 2, relative to the trailing edge 22 of the main vane 20 by the distance 27 in the axial direction.

In a fifth embodiment (FIG. 10) the main vane 20 and the auxiliary vane 21 can also completely overlap. In other words the trailing edge 26 of the auxiliary vane 21 is arranged offset positively in the axial direction by the distance 28, i.e. in the direction of the leading edge 9 of the fan hub 2. The distance from the trailing edge 26 of the auxiliary vane 21 to the leading edge 29 of the main vane 20 is in this case shorter than the distance from the trailing edge 22 of the main vane 20 to its leading edge 29. Furthermore the leading edge 23 of the auxiliary vane is displaced positively in the axial direction beyond the leading edge 29 of the main vane 20.

Figure 11:
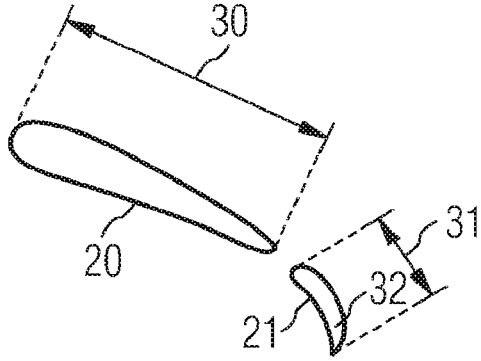
FIG. 11 shows a schematic representation of a sixth embodiment.
Figure 12:
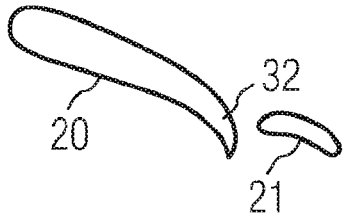
FIG. 12 shows a schematic representation of a seventh embodiment.
Figure 13:
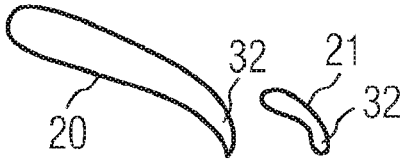
FIG. 13 shows a schematic representation of an eighth embodiment.
Figure 14:
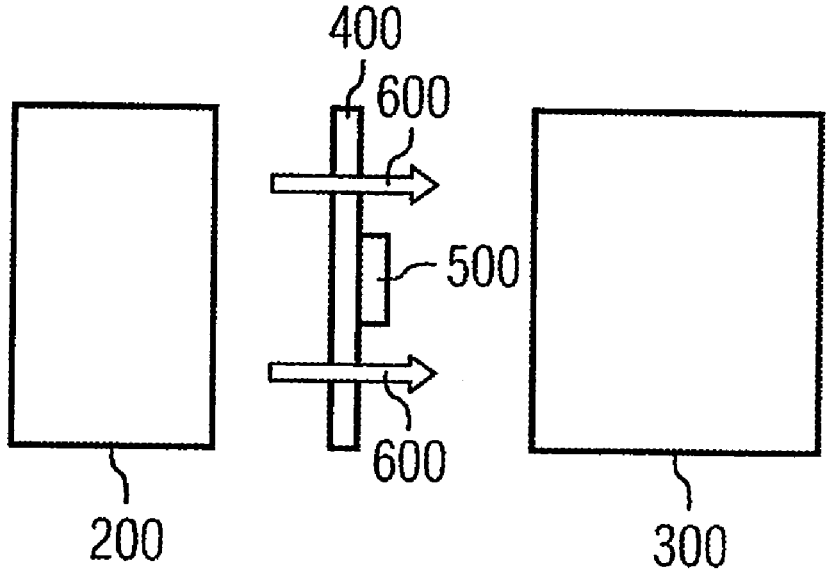
FIG 14 PRIOR ART
FIG. 14 shows a schematic representation of a purely axial air flow through a conventional fan module.
Figure 15:
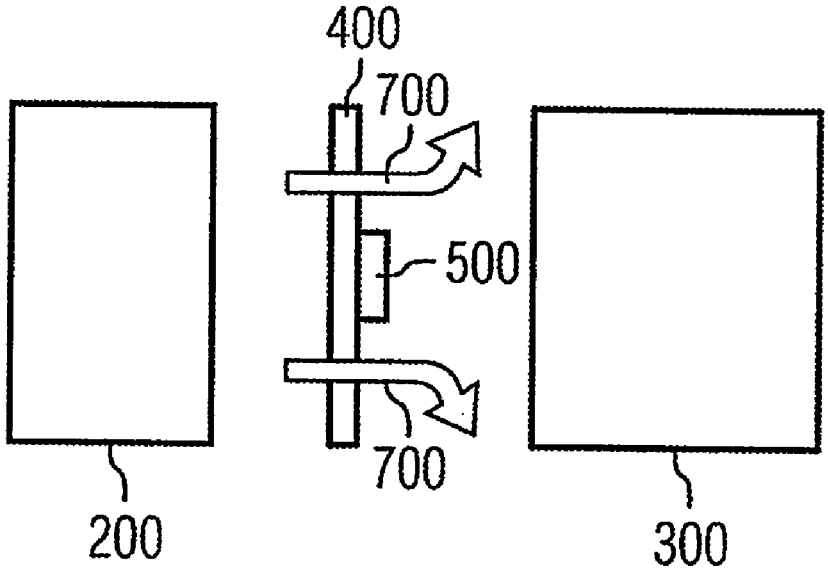
FIG 15 PRIOR ART
FIG. 15 shows a schematic representation of an axial-radial air flow through a conventional fan module.

In a sixth embodiment (FIG. 11) the auxiliary vane 21 is—similarly to those shown in FIGS. 6 to 10—strongly curved in the area of its trailing edge 26. In a seventh embodiment (FIG. 12) the main vane 20 is strongly curved in the area of its trailing edge 22. In an eighth embodiment (FIG. 13) both the main vane 20 and the auxiliary vane 21 are strongly curved in the area of their trailing edges 22, 26. In all these cases the strong curvature 32 always serves to intensify the air flow.

Figure 10:
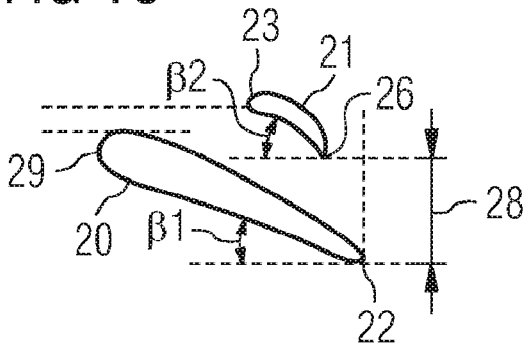
FIG. 10 shows a schematic representation of a fifth embodiment.

In all of the examples described and presented in the foregoing the chord length 30 of the main vane 20 is always greater than the chord length 31 of the auxiliary vane 21; cf. FIG. 10. According to an embodiment, however, the chord length 30 of the main vane 20 can also be less than or equal to the chord length 31 of the auxiliary vane 21. The actual dimensioning is greatly dependent here on the particular intended use.

The invention claimed is:

1. A fan module for cooling motor vehicle engines, comprising:

a fan housing, a fan motor disposed in the fan housing, a fan wheel driven by the fan motor, wherein the fan housing has fixed air guiding elements which are arranged in the area of a fan hub of the fan wheel and only partially cover an outlet cross-section defined by the fan housing, fan blades arranged at the fan hub, with a number of fan blades in the area of the fan hub having a fan blade section, which fan blade section is embodied in the manner of a fixed split flap, wherein the fan blade section has the flow opening arranged in the area of the trailing edge of the fan blade.

2. The fan module according to claim 1, wherein the air guiding elements cover an area of 10 to 50 percent of the outlet cross-section.

3. The fan module according to claim 1, wherein air guiding elements are arranged at an angle of attack $\alpha$ relative to the flow direction of the cooling air and that the angular position of the air guiding elements is dependent on the radius of the fan wheel.

4. The fan module according to claim 3, wherein the angle of attack $\alpha$ of the air guiding elements is between $\alpha=12°$ for $r=d$ and $\alpha=45°$ for $r=1.3\times d$, where "r" denotes the radius of the fan wheel and "d" the diameter of the fan hub.

5. The fan module according to claim 1, wherein the outer ends of the air guiding elements are connected to one another by way of an outer race.

6. The fan module according to claim 1, wherein the radial length of the flow opening corresponds to a maximum of 30 percent of the hub radius.

7. The fan module according to claim 1, wherein the width of the flow opening is between 35 and 45 percent of the fan blade width.

8. The fan module according to claim 1, wherein the angle of attack of the fan blade section is 40 to 55 degrees greater than the angle of attack of the fan blade 2.

9. The fan module according to claim 1, wherein the radial length of the flow opening is dimensioned in such a way that the flow opening terminates with the outer race of the air guiding elements.

10. A fan module comprising a fan housing, a fan motor disposed in the fan housing, and a fan wheel driven by the fan motor, wherein the fan housing has fixed air guiding elements which are arranged in the area of a fan hub of the fan wheel and only partially cover an outlet cross-section defined by the fan housing, wherein fan blades are arranged at the fan hub, with a number of fan blades in the area of the fan hub having a fan blade section for the purpose of forming a flow opening, which fan blade section is embodied in the manner of a fixed split flap for the purpose of generating an increased static air pressure close to the fan hub, wherein the fan blade section has the flow opening arranged in the area of the trailing edge of the fan blade.

11. The fan module according to claim 10, wherein the air guiding elements cover an area of 10 to 50 percent of the outlet cross-section.

12. The fan module according to claim 10, wherein air guiding elements are arranged at an angle of attack $\alpha$ relative to the flow direction of the cooling air and that the angular position of the air guiding elements is dependent on the radius of the fan wheel.

13. The fan module according to claim 12, wherein the angle of attack $\alpha$ of the air guiding elements is between $\alpha=12°$ for $r=d$ and $\alpha=45°$ for $r=1.3\times d$, where "r" denotes the radius of the fan wheel and "d" the diameter of the fan hub.

14. The fan module according to claim 10, wherein the outer ends of the air guiding elements are connected to one another by way of an outer race.

15. The fan module according to claim 10, wherein the radial length of the flow opening corresponds to a maximum of 30 percent of the hub radius.

16. The fan module according to claim 10, wherein the width of the flow opening is between 35 and 45 percent of the fan blade width.

17. The fan module according to claim 10, wherein the angle of attack of the fan blade section is 40 to 55 degrees greater than the angle of attack of the fan blade.

18. The fan module according to claim 10, wherein the radial length of the flow opening is dimensioned in such a way that the flow opening terminates with the outer race of the air guiding elements.

* * * * *